United States Patent [19]

Fry

[11] Patent Number: 4,739,632

[45] Date of Patent: Apr. 26, 1988

[54] LIQUID INJECTION COOLING ARRANGEMENT FOR A ROTARY COMPRESSOR

[75] Inventor: Emanuel D. Fry, Tecumseh, Mich.

[73] Assignee: Tecumseh Products Company, Tecumseh, Mich.

[21] Appl. No.: 898,438

[22] Filed: Aug. 20, 1986

[51] Int. Cl.[4] ..... F25B 31/00

[52] U.S. Cl. ..... 62/505

[58] Field of Search ..... 62/505

[56] References Cited

U.S. PATENT DOCUMENTS

| | | | |
|---|---|---|---|
| 2,949,128 | 8/1960 | Carter . | |
| 3,064,447 | 11/1962 | Heldorn | 62/197 |
| 3,109,297 | 9/1961 | Rinehart | 62/197 |
| 3,111,820 | 11/1963 | Atchison | 62/505 |
| 3,191,403 | 6/1965 | Ladusaw | 62/505 |
| 3,276,221 | 10/1966 | Crumley | 62/197 |
| 3,396,550 | 8/1968 | Cawley | 62/117 |
| 3,402,571 | 9/1968 | Warner | 62/505 |
| 3,795,117 | 3/1974 | Moody | 62/197 |
| 3,945,220 | 3/1976 | Kosfeld | 62/505 |
| 4,006,602 | 2/1977 | Fanberg | 62/113 |
| 4,049,410 | 9/1977 | Mileer | 62/197 |
| 4,254,637 | 3/1981 | Brauch | 62/468 |
| 4,326,868 | 4/1982 | Ozu | 62/324 |
| 4,331,002 | 5/1982 | Ladusaw | 62/505 |
| 4,446,704 | 5/1984 | Yamazaki | 62/180 |
| 4,462,219 | 7/1984 | Iwata | 62/196 |
| 4,636,152 | 1/1987 | Kawaguchi et al. | 418/54 |

FOREIGN PATENT DOCUMENTS

| | | | |
|---|---|---|---|
| 713286 | 7/1965 | Canada | 62/71 |

*Primary Examiner*—Ronald C. Capossela

*Attorney, Agent, or Firm*—Jeffers, Hoffman & Niewyk

[57] ABSTRACT

An injection cooling arrangement for a rotary compressor whereby the heat of compression may be reduced more efficiently. A liquid refrigerant line is connected to the high pressure side of the refrigeration system between the condenser and the expansion device at one end thereof and at the other end is connected to a refrigerant inlet path located within the compression cylinder. The inlet path is connected to an orifice leading into the compression bore. The inlet path decreases in cross-sectional area as it leads from the liquid injection line to the orifice. The orifice is sized to allow for the restriction to take place at the entrance to the compression cylinder.

6 Claims, 3 Drawing Sheets

LIQUID INJECTION COOLING ARRANGEMENT FOR A ROTARY COMPRESSOR

BACKGROUND OF THE INVENTION

This invention relates generally to a liquid injection cooling arrangement for a rotary compressor. More specifically, the present invention is directed to a liquid refrigerant injection arrangement wherein the liquid refrigerant line is connected from the high pressure side of a refrigeration system to a liquid refrigerant inlet path in the compression cylinder. The inlet path for the liquid refrigerant is routed through the compression cylinder and is provided with an orifice leading into the compression bore. The inlet path decreases in cross-section as it leads from the liquid injection line to the orifice.

Liquid injection methods have been utilized in prior art rotary compressors to reduce the temperatures of the compressor motor windings and the lubricating oil. This has been accomplished by providing liquid refrigerant from the condenser and by using capillary tubes externally of the compressor to provide the necessary pressure drop from the condenser to the compressor cylinder. When the compressor roller exposes the liquid injection aperture in the compressor bore to higher pressures, the refrigerant within the liquid injection aperture and within the path leading from the aperture to the capillary tube is compressed. Then, when the roller revolves further to expel the compressed refrigerant and, thus, generates a lower pressure in the compressor bore permitting refrigerant to flow into the bore from the suction inlet, the refrigerant in the liquid injection aperture and the path leading from the aperture to the capillary tube expands. This cyclical compression and re-expansion of the refrigerant requires work. Thus, because this work is provided by the compressor motor, the compressor overall efficiency is decreased by this prior art method of liquid injection.

In the past, attempts have made to eliminate the above-described lost work of compression and re-expansion by locating the aperture which conducts liquid refrigerant into the compression bore so that the aperture will always be closed by the roller prior to the time at which the pressure within the compression bore becomes greater than the pressure of the refrigerant within the aperture. However, because the pressures of refrigeration systems vary with various atmospheric and loading conditions, the aperture leading into the compression bore must be located within the compression cylinder so that it will be closed prior to the increase of pressure within the bore in excess of the pressure within the aperture under a variety of atmospheric and loading conditions. Consequently, the amount of cooling provided by the liquid injection system is severely limited because refrigerant is introduced into the compression bore over a shorter period of time. This is due to the location of the aperture at a point in the compressor cylinder so as to prevent compression and re-expansion under all atmospheric and load conditions. In other words, under certain atmospheric and loading conditions, the pressure within the compression bore does not become greater than the pressure of the refrigerant in the aperture until the roller has passed substantially beyond the aperture location. Thus, under those conditions, liquid refrigerant insertion cooling which could have been efficiently provided to the motor windings and the lubricating oil is prevented from occurring.

The rotary compressor motor, therefore, runs at a higher temperature and the overall efficiency of the refrigeration system is decreased.

Another condition which can vary the pressure of the refrigerant in the aperture to assure that the pressure within the cylinder bore does not exceed the pressure of the refrigerant within the liquid refrigerant injection aperture, is the pressure drop in the liquid refrigerant line leading from the high pressure side of the refrigeration system to the liquid refrigerant injection aperture. Depending on the length, diameter and the interior surface of the liquid refrigerant line, the pressure delivered to the liquid refrigerant injection aperture leading into the compression bore will vary. Further, because during the manufacture of refrigeration systems various compressor cylinders are used with various types of liquid refrigerant lines, the pressure of the refrigerant delivered to the liquid refrigerant injection aperture may vary. Thus, in the design of a liquid injection system, sufficient pressure must be provided for the injected liquid refrigerant to account for the work performed during compression and re-expansion of the refrigerant within the liquid refrigerant path and by the pressure drop in the liquid refrigerant line so that the pressure of the liquid refrigerant exceeds the pressure within the compressor cylinder when the aperture is exposed. In the past, this has been accomplished by shifting the location of the aperture so that the pressure within the cylinder bore, whenever the aperture is open, is always greater than the pressure of the refrigerant within the aperture for any given liquid refrigerant line to be connected thereto. As discussed above, this decreases the amount of cooling provided to the motor when using refrigerant lines which can deliver a greater pressure and thus decreases the overall efficiency of the refrigeration system.

Another problem associated with the prior art liquid injection cooling methods is that the capillary tubes which have been used to provide the necessary pressure drop add to the overall cost of the refrigeration systems.

SUMMARY OF THE INVENTION

It is the principal object of the invention to overcome the above-discussed disadvantage associated with prior art liquid injection arrangements. More specifically, it is the object of this invention to reduce the amount of re-expansion which occurs in a liquid injection inlet path and in the liquid injection aperture leading into the cylinder compression bore while providing a maximum possible amount of cooling of the compressor. Furthermore, it is desired to eliminate the need for a capillary tube for providing a pressure drop.

The objects of the invention are obtained by providing an inlet path connected to a liquid refrigerant line which is connected to the high pressure side of a refrigeration system. The inlet path is also connected to an orifice leading into the compression chamber. The inlet path width decreases in cross-section as the path leads from the liquid refrigerant line to the orifice. As the refrigerant traverses the inlet path, it remains in its liquid state. However, the refrigerant is heated due to the elevated temperature of the compressor cylinder. The orifice provides the sole restriction and pressure drop in the injection cooling arrangement and substantially eliminates compression and re-expansion of refrigerant in the liquid refrigerant injection path. The orifice is sized to assure that minimal compression and re-expansion will occur in the orifice and in the inlet path. By providing a restriction only at the entrance to the compression chamber, compression and re-expansion is reduced and the compressor efficiency is increased. Furthermore, the need for a capillary tube is eliminated.

By providing an inlet path and an orifice as described above, more efficient liquid injection cooling is provided. This is because the orifice can be positioned at a more optimum location in the compressor bore than was possible with prior art arrangements as explained hereinabove. The orifice may be located substantially so that the highest compressor efficiency is achieved during the most commonly encountered atmospheric, loading and friction drag conditions. Because the structure disclosed herein minimizes the amount of refrigerant compression and re-expansion which occurs within the orifice and the liquid refrigerant line, the amount of lost work is substantially minimized. Furthermore, under ideal conditions, by virtue of the advantageous orifice location, liquid injection cooling is provided over a longer portion of each revolution of the roller. Therefore, the present invention provides a liquid injection cooling arrangement whereby the overall efficiency of the refrigeration system is increased due to the minimization of compression and re-expansion and the maximization of liquid injection cooling.

The invention, in one form thereof, provides a compression bore defined by a compression cylinder for compressing the refrigerant of the refrigeration system. An orifice is provided leading into the compression bore for introducing refrigerant into the bore. A liquid refrigerant inlet path within the compression cylinder is provided so as to conduct liquid refrigerant to the orifice.

The invention, in one form thereof, provides an injection cooling arrangement wherein a cylinder bore is defined by a compression cylinder including a compression bore therein, a top planar portion, and a lower planar portion. A roller is eccentrically rotatably mounted within the cylinder bore. A vane slot is provided within the compression cylinder and a sliding vane is received within the vane slot. A means for resiliently biasing the vane is provided so as to engage the vane with the roller thereby defining a high pressure chamber and a low pressure chamber in the cylinder bore. An orifice on the lower planar portion leading to the high pressure chamber is provided and is opened and closed by the roller which rotates and slides over the lower planar portion. A liquid refrigerant inlet path is provided for connecting a liquid refrigerant supply to the orifice, and the cross-sectional area of the inlet path decreases from the liquid refrigerant line to the orifice.

The invention, in one form thereof, provides a hermetically sealed rotary compressor having a compression cylinder and a roller mounted within the cylinder for eccentric rotation. The cylinder and the roller define a compression chamber. A radial vane slot is located within the compression cylinder and a sliding vane is slidingly positioned in the vane slot. A biasing means is provided for pushing the vane against the roller whereby the compression chamber is divided into a high pressure side and a low pressure side. A liquid injection cooling arrangement is provided wherein a liquid refrigerant line is connected to the high pressure side of the system downstream from the condenser. The liquid refrigerant line is sealingly connected to a liquid refrigerant inlet path made up of three interconnected bores. Each bore has a decreasing diameter and the first of the three bores is connected to the liquid refrigerant line and has a smaller diameter than the line. An orifice, connected to the last of the three bores, communicates with the high pressure side of the chamber.

BRIEF DESCRIPTION OF THE DRAWINGS

The above mentioned and other features and objects of this invention and the manner of attaining them will become more apparent, and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
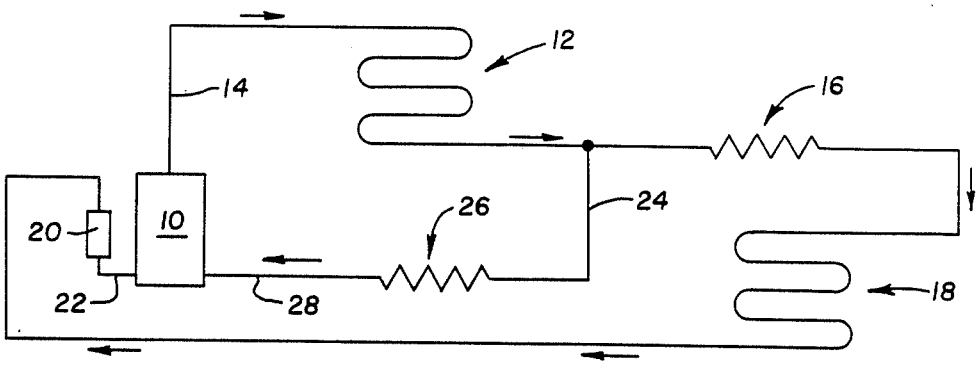
FIG. 1 is a schematic view of a refrigeration system showing the injection cooling line of the present invention.

In an exemplary embodiment of the invention as shown in the drawings and, in particular, by referring to FIG. 1 wherein a schematic diagram of a refrigeration system is shown, a rotary compressor 10 is connected to condenser 12 via high pressure discharge line 14. The main flow path of the refrigerant leads through expansion device 16, evaporator 18, accumulator 20 and thereafter re-enters rotary compressor 10 via suction line 22. To reduce the heat of compression within rotary compressor 10, refrigerant is introduced into the compression chamber of the rotary compressor by diverting liquid refrigerant from condenser 12 through liquid refrigerant take off line 24, liquid refrigerant restriction 26, and through liquid refrigerant line 28.

Figure 2:
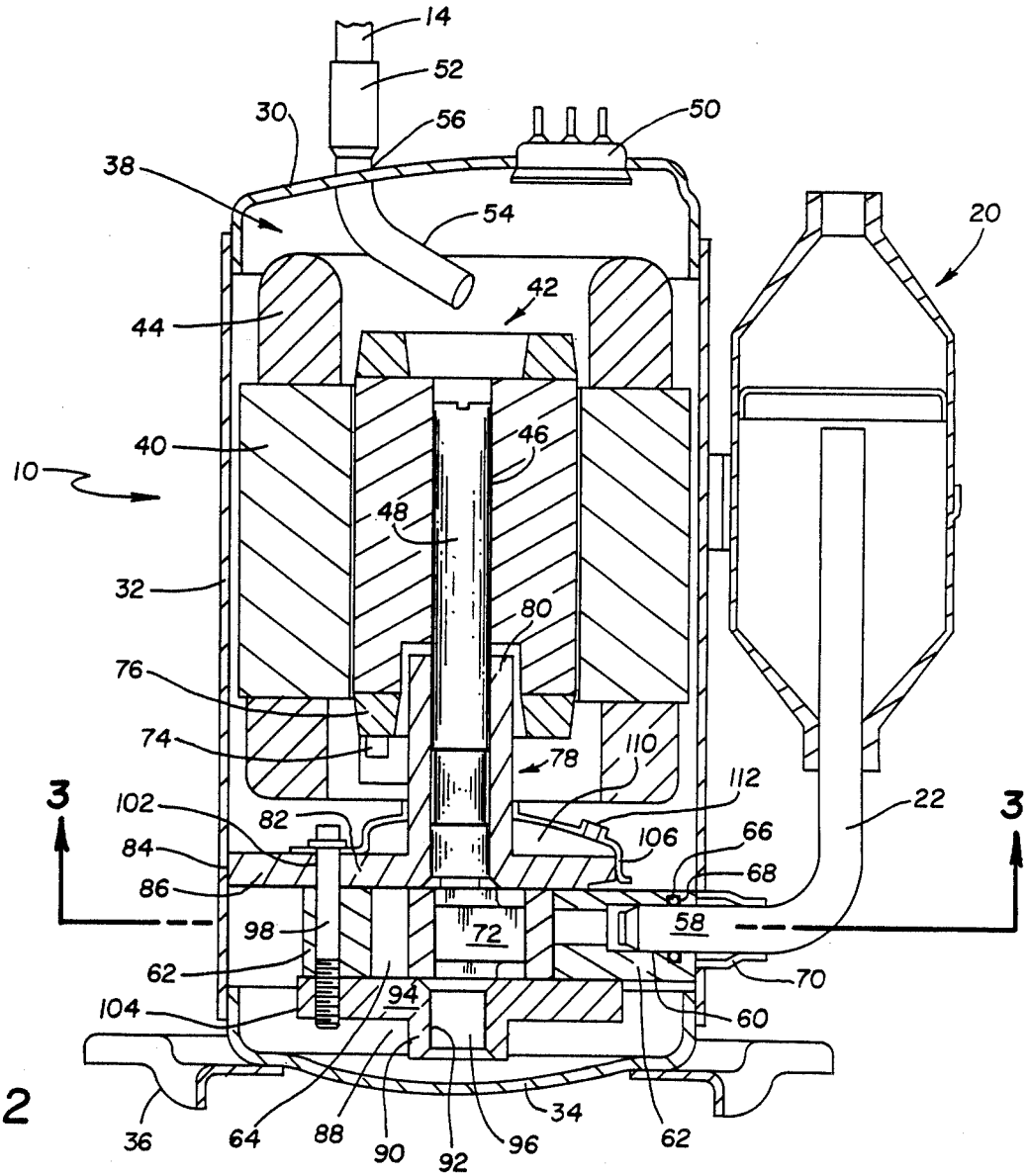
FIG. 2 is a cross-sectional elevational view of the compressor schematically shown in FIG. 1.
Figure 3:
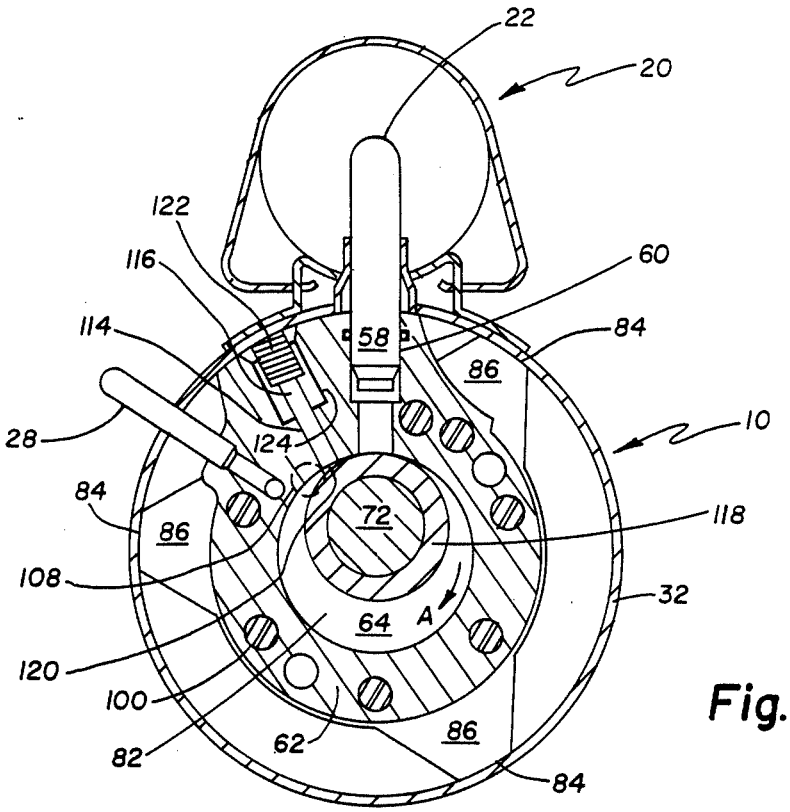
FIG. 3 is a cross-sectional bottom plan view of the compressor taken along lines 3—3 of FIG. 2.
Figure 4:
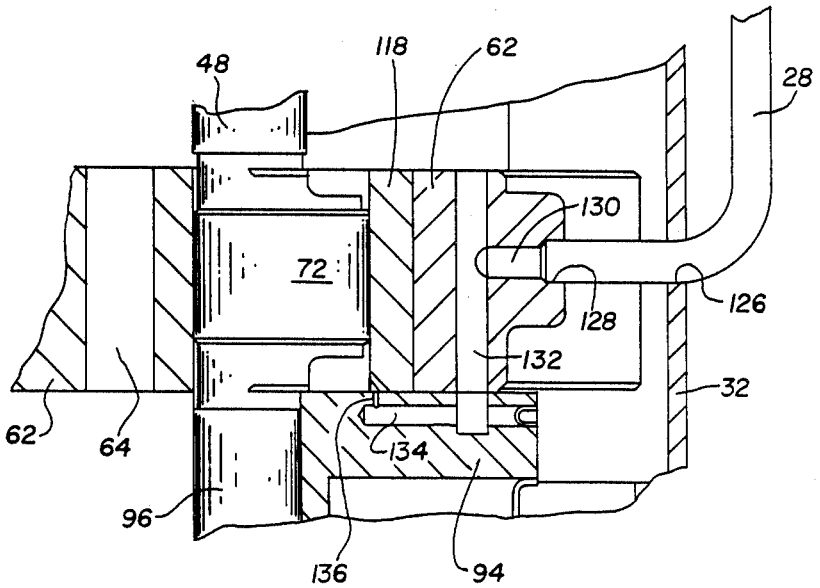
FIG. 4 is an enlarged partial cross-sectional elevational view of the compressor of FIG. 2 showing the liquid refrigerant line, inlet path and orifice leading into the compression chamber.

Referring now to FIGS. 2–4, rotary compressor 10 is shown having a housing top portion 30, a housing central portion 32 and a housing lower portion 34. The three housing portions are hermetically secured together by welding or brazing. A flange 36 is welded to the bottom of the housing lower portion 34 for mounting the compressor to an exterior structure (not shown). Disposed inside the hermetically sealed housing is a motor generally designated at 38 having a stator 40 and a rotor 42. The stator is provided with windings 44. Stator 40 is secured to housing central portion 32 by an interference fit such as by shrink fitting. Rotor 42 has a central aperture 46 in which is secured crankshaft 48 such as by an interference fit. A terminal cluster 50 is provided on housing top portion 30 for connecting the compressor motor 38 to a source of electrical power.

A refrigerant discharge tube 52 extends through housing top portion 30 and has an end portion 54 thereof extending into the interior of the compressor as shown in FIG. 2. Refrigerant discharge tube 52 is connected to high pressure discharge line 14. Refrigerant discharge tube 52 is sealingly connected to housing top portion 30 at 56 as by soldering.

Similarly, suction line 22 extends into the interior of housing central portion 32 and is sealed thereto as best illustrated in FIG. 2. Suction line 22 includes a portion 58 which extends into an aperture 60 located in the wall of cylinder 62. Suction line 22 is sealed to aperture 60 in any suitable manner such as by means of an 0-ring 66 housed in an annular recess 68 of cylinder 62. A cylindrical soldering flange 70 secures suction line 22 to housing central portion 32. The outer end of suction line 22 is connected to accumulator 20 as shown in FIG. 2.

Crankshaft 48 is provided with an eccentric portion 72 which revolves around the crankshaft axis as crankshaft 48 is rotatably driven by motor 42. A counterweight 74 is provided to balance eccentric portion 72 and is secured to the end ring 76 of rotor 42. Crankshaft 48 is journalled in main bearing 78 having a cylindrical journal portion 80 and a generally flat planar mounting portion 82. Planar portion 82 is secured to housing central portion 32 at three points 84 by welding flanges 86 to housing central portion 32 as best illustrated in FIG. 3.

A second or lower bearing or journal 88, sometimes referred to as the outboard bearing, is shown disposed within housing lower portion 34. Second bearing 88 is provided with a journalling portion 90 having aperture 92 therein and a generally planar portion 94. Crankshaft 48 has a lower portion 96 journalled in journalling portion 90 of second lower bearing 88 as illustrated in FIG. 2.

Located intermediate main bearing 78 and second lower bearing 88 is compressor cylinder 62. Main bearing 78, compressor cylinder 62 and lower bearing 88 are secured together by six bolts 98, one of which is indicated in FIG. 2. By reference to FIG. 3, it can be seen that six holes 100 are provided in compressor cylinder 62 for securing bearings 78 and 88 and cylinder 62 together. Bolts 98 extend through holes 102 in main bearing 78, holes 100 in cylinder 62 and into threaded holes 104 located in second lower bearing 88.

Discharge muffler 106 is also secured to main bearing 78 by bolts 98 as shown in FIG. 2. Compressed refrigerant gas is discharged through relief 108 into discharge space 110 defined by discharge muffler 106 and the top surface of planar bearing portion 82. From discharge space 110, the refrigerant exits into housing central portion 32 through three openings 112 in discharge muffler 106, one of which is indicated in FIG. 2.

Referring to FIG. 3, it can be seen that compressor cylinder 62 has a vane slot 114 provided in the cylinder wall thereof into which there is received a sliding vane 116. Roller 118 is provided between planar portion 82 of main bearing 78 and planar portion 94 of second lower bearing 88. Roller 118 surrounds eccentric portion 72 of crankshaft 48 and revolves around the axis of crankshaft 48 as it is driven by eccentric portion 72. Tip 120 of sliding vane 116 is in continuous engagement with roller 118 because vane 116 is continuously urged against roller 118 by spring 122 which is received in spring pocket 124. High pressure chamber 65 and low pressure chamber 67 are thus defined within compression bore 64 by vane 116, roller 118, and planar portions 82 and 94 as illustrated in FIGS. 5*a*–5*d*.

Referring further to FIGS. 2 and 3, as roller 118 revolves around within cylinder bore 64 in the direction indicated by arrow A, high pressure chamber 65 defined by roller 118, sliding vane 116 and planar portions 82 and 94 of bearings 78 and 88 respectively, decreases in size. Refrigerant contained in high pressure chamber 65 is therefore compressed and thereafter exits through relief 108 located in compression cylinder 62. A discharge valve (not shown) located in main bearing 78 allows the refrigerant to be discharged into discharge volume 110. The refrigerant thereafter exits from discharge volume 110 through discharge openings 112 and travels into the sealed housing of the rotary compressor and into motor windings 44 whereby the windings are cooled.

Figure 5A:
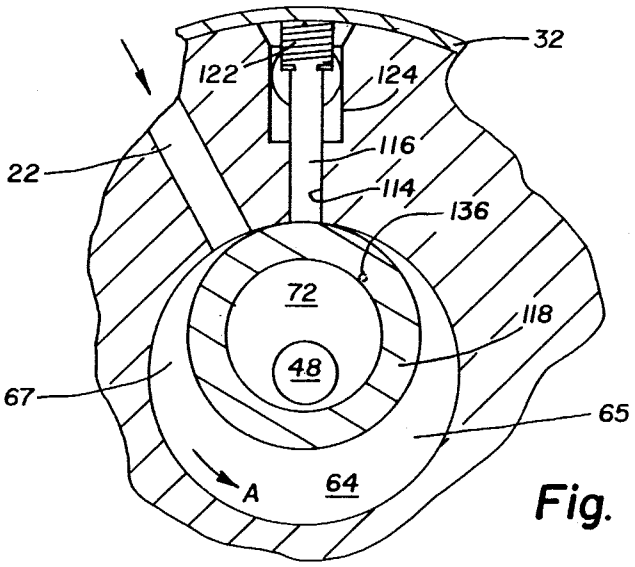
FIG. 5*a* is a partial cross-sectional top plan view of the compressor of FIG. 2 showing the compression chamber and the orifice when the roller is centered with the vane.
Figure 5B:
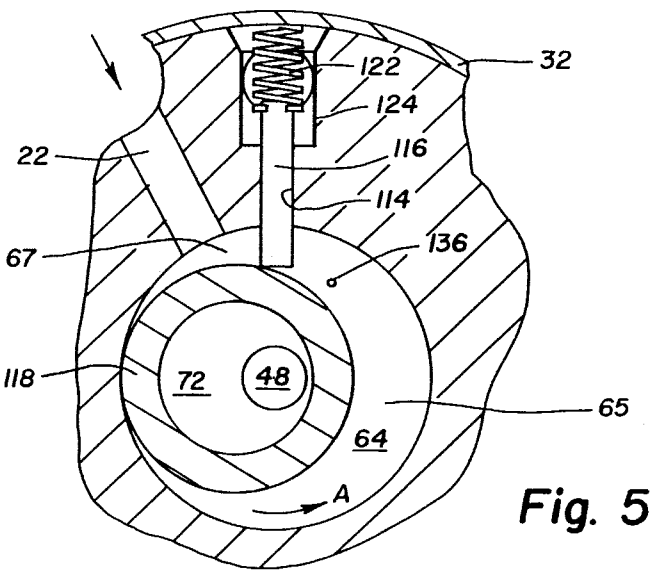
FIG. 5*b* is a partial cross-sectional top plan view of the compressor of FIG. 2 showing the orifice in an open position when the roller has rotated 90° counterclockwise from the vane.
Figure 5C:
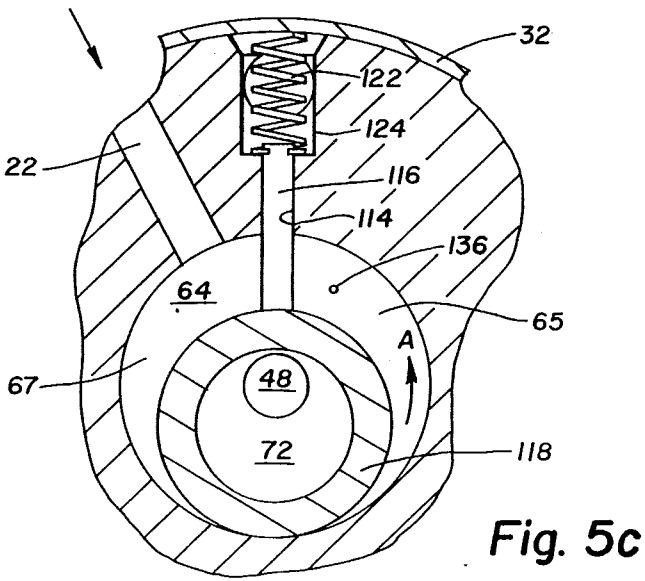
FIG. 5*c* is a partial cross-sectional top plan view of the compressor of FIG. 2 showing the orifice in an open position when the roller has rotated 180° counterclockwise from the vane.
Figure 5D:
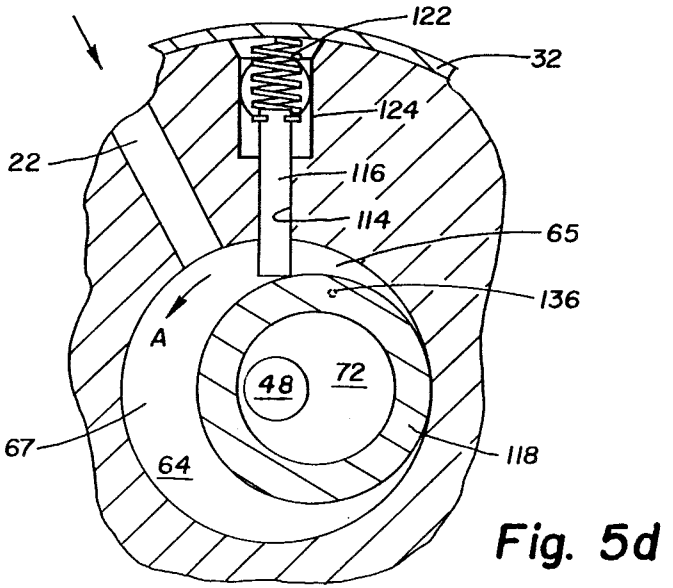
FIG. 5*d* is a partial cross-sectional top plan view of the compressor of FIG. 2 showing the orifice in a closed position when the roller has rotated 270° counterclockwise from the vane.

Referring now to FIGS. 5*a*–5*d*, the compression operation will be described. As shown in FIG. 5*a*, when roller 118 is centered with vane 116, orifice 136 is closed and refrigerant is not able to enter compressor cylinder bore 64. When roller 118 has rotated 90° counterclockwise from vane 116 as seen in FIG. 5*b*, it can be seen that low pressure chamber 67 and high pressure chamber 65 are defined within compression cylinder bore 64 on respective opposite sides of vane 116. At 90°, orifice 136 communicates with high pressure chamber 65 of cylinder bore 64 and liquid refrigerant can enter and expand therein for the purpose of reducing the heat of compression. When roller 118 is rotated 180° counterclockwise from the vane location as seen in FIG. 5*c*, refrigerant may still enter high pressure chamber 65. Finally, as shown in FIG. 5*d*, when roller 118 is rotated 270° counterclockwise from vane 116, orifice 136 is closed thereby preventing the refrigerant from entering high pressure chamber 65 and, when the pressure within pressure chamber 65 is greater than the refrigerant pressure within the liquid refrigerant line, preventing backflow of refrigerant into orifice 136 and the liquid refrigerant inlet line.

As best seen in FIG. 4, there is provided a liquid refrigerant line 28 which as described hereinabove, is connected to and receives liquid refrigerant from the condenser 12. Referring to FIG. 4, liquid refrigerant line 28 enters hermetically sealed compressor 10 through housing central portion 32 via hole 126 and is sealingly secured to the housing by welding or soldering. Line 28 is thereafter received in bore 128 of compressor cylinder 62 and is sealingly held therein by welding, soldering or other suitable means. Liquid refrigerant is thus caused to travel through line 28, bores 130, 132 and 134 and orifice 136 and thereby enters cylinder bore 64 whenever orifice 136 is not sealingly covered by roller 118 and the pressure in high pressure chamber 65 is less than the refrigerant pressure in bore 134.

Orifice 136 is located within planar portion 94 such that it will be closed by roller 118 just prior to the time when the pressure within pressure chamber 65 becomes equal to the pressure of the refrigerant within bore 134. The location of orifice 136 is determined by the refrigerant pressure available within bore 134 during the most common loading and atmospheric conditions to which the refrigeration system will be subjected. The pressure within pressure chamber 65 is a function of the location of roller 118 as it eccentrically rotates within compression bore 64. Further, the refrigerant pressure within bore 134 is a function of the refrigerant pressure within the condenser which fluctuates depending on the refrigeration loading and atmospheric conditions. The refrigerant pressure within bore 134 is also a function of the friction drag or pressure loss within liquid refrigerant line 24, restriction 26 and line 28. The friction drag varies depending on the diameter, length and the interior surface of lines 24, restriction 26 and line 28. Thus, once the most common loading conditions are determined for the refrigeration system, the refrigerant pressure within orifice 136 is determined for those conditions and the point of when the pressure within pressure chamber 65 is equivalent to the pressure of the refrigerant within orifice 136 during those ideal conditions with respect to roller 118 is determined. The orifice is thereafter located in planar portion 94 such that roller 118 will close orifice 136 immediately prior to the time when the pressure within pressure chamber 65 becomes greater than the pressure within bore 134 under the most commonly occurring above-mentioned conditions.

It has been found that by selecting the diameter of orifice 136 so that it provides the proper pressure drop from liquid refrigerant bore 134 to the cylinder compression chamber and by locating orifice 136 as described above for the most commonly occurring atmospheric, load and friction drag conditions, an increase in the efficiency of the compressor is achieved.

Furthermore, as shown in FIG. 4, it has been found that compressor efficiency is increased by continually decreasing the width of the inlet path for the liquid refrigerant as it enters rotary compressor 10 via liquid refrigerant line 28 and reaches orifice 136. That is, the inside diameter of bore 130 is slightly smaller than the inside diameter of liquid refrigerant line 28. The diameter of bore 132 which travels downwardly through cylinder 62 and planar portion 94 is slightly smaller than the diameter of bore 130, and finally, the diameter of bore 134 located in planar portion 94 is smaller than bore 132 and larger than orifice 136.

By continually decreasing the cross-sectional area of the liquid refrigerant inlet path, by providing an orifice 136 sized as described above, and by locating orifice 136 as described above with respect to most commonly occurring loading conditions, the efficiency of the compressor is significantly increased. Compressor efficiency may be further increased by eliminating restriction 26, commonly known as a capillary tube, so that orifice 136 provides the only restriction in the liquid refrigerant injection circuit.

The increase in compressor efficiency may best be understood by considering three situations which may occur in the refrigeration system as it applies to the injection cooling arrangement. The first situation is when the most common atmospheric, loading and friction drag conditions occur such that orifice 136 is closed immediately prior to the time when the pressure within pressure chamber 65 equals or exceeds the refrigerant pressure in bore 134. Under this first situation, it is evident that refrigerant will flow into compression bore 64 until the last possible moment after which time compression and re-expansion of the refrigerant within orifice 136 and the inlet path would occur. However, under this first condition, no compression and re-expansion occurs because orifice 136 is closed by roller 118 just prior to the time when the pressure within chamber 65 becomes greater than the refrigerant pressure within bore 134. Thus, work performed in compressing and re-expanding the refrigerant within orifice 136 is avoided while cooling of motor windings 44 is maximized. Consequently, motor 38 runs at a lower temperature and draws less electrical power, thereby causing the compressor to be more efficient.

A second possible situation occurs when the atmospheric, loading and friction drag conditions are such that the pressure within pressure chamber 65 does not increase in excess of the refrigerant pressure within orifice 136 until a point in time substantially after orifice 136 has been closed by roller 118. During this situation, it is evident that refrigerant could have been injected into pressure chamber 65 until a point later in time in the compression cycle when in fact the pressure within pressure chamber 65 is equivalent to the refrigerant pressure within orifice 136. The maximum liquid injection cooling which could potentially occur during the second condition is thus unavailable and, thus, the compressor does not run as cool as would be possible, if the liquid injection orifice had been located so that orifice would open for a greater amount of time during the compression cycle. However, with the presently disclosed structure and location of the orifice, the lost cooling is substantially negligible. This is true because orifice 136 is located at a point, as described above, to be open and unobstructed for a substantially greater time than was provided in the prior art compressor structures.

The third possible situation occurs when atmospheric, loading and friction drag conditions are such that the pressure within pressure chamber 65 becomes greater than the refrigerant pressure within orifice 136 prior to the point when roller 118 closes orifice 136. Under this third situation, the refrigerant within orifice 136 and the inlet path may be compressed by the greater pressure which occurs in high pressure chamber 65 and, when the orifice is closed, is allowed to re-expand. Although, under this third situation, liquid refrigerant is injected into pressure chamber 65 until the last possible moment when the pressure within pressure chamber 65 is equal to the refrigerant pressure within orifice 136, the constant compression and re-expansion of the refrigerant within orifice 136 and the liquid refrigerant inlet path requires work and may cause the compressor to be inefficient. However, the presently disclosed inlet path and orifice 136, substantially reduces the compression and re-expansion which may occur during the third situation. By providing an orifice immediately leading into compression bore 64 and an inlet path which continually decreases in diameter, a considerable restriction occurs at the entrance to compression bore 64. Thus, the pressure drop across the orifice prevents substantial compression and re-expansion. Further, due to the small orifice, only a small volume of refrigerant is moved a small distance due to the occurrence of compression and re-expansion within orifice 136 and the inlet path. Accordingly, the overall work done or energy consumed by compression and re-expansion is significantly decreased as compared with prior art compressor structures.

If an aperture of substantial size rather than an orifice was provided, the volume of refrigerant exposed to compression and re-expansion would increase along with the distance which the refrigerant is caused to travel. Thus, the increased volume of refrigerant and the longer distance which it must travel would require more work and thus the overall compressor efficiency would be substantially decreased.

It should also be noted that an aperture may also allow liquid refrigerant to be injected into compression bore 64 without expanding and thereby fail to decrease the heat of expansion and the overall running temperature of the compressor. Furthermore, if the diameter of orifice 136 is too small, an insufficient amount of liquid refrigerant may be injected and cooling may be insufficient.

It should be noted that the size of the orifice depends upon the amount of refrigerant which is required for cooling the compressor cylinder. The pressure drop across the orifice is a function of mass flow. Thus, to calculate the size of the orifice, we start with the total mass flow of the compressor at selected design conditions. Assuming the refrigerant mass flow for liquid injection to be between 8% and 20% of the total refrigerant mass flow of the compressor, then to calculate the required orifice diameter, by standard calculations taken, for instance, from the ASME Interim Supplement 19.5, Application Part 11 of Fluid Meters, sixth edition, 1971, we can write:

$$d = \sqrt{\frac{\text{mass flow required (mass flow/hour)}}{1778.38 \times \sqrt{\delta \times \Delta P}}}$$

wherein:

d=orifice diameter (inches)
δ=density of fluid #/f$^3$
P=differential pressure (psi)
1778.38 is a constant based on:
area thermal expansion factor
coefficient of discharge factor
expansion factor
flow coefficient factor Thus, for example, if the compressor mass flow is 180 lbs/hour at required conditions, the mass flow required for a liquid injection rate of 15% is:

$$0.15 \times 180 = 27 \text{ lbs/hour}$$

then, if

P=80 psi across the orifice
δ=4.83 lbs/f$^3$ (from the freon tables)
Therefore, $$d = \sqrt{\frac{27}{1778.38 \times \sqrt{4.83 \times 80}}} = 0.028 \text{ inches}$$

Further yet, by providing a continuously decreasing cross-sectional area of the liquid refrigerant inlet path leading to orifice 136 and by eliminating liquid refrigerant restriction 26, more commonly known as a capillary, the pressure delivered to orifice 136 is maximized and, thus, the compression and re-expansion due to the fluctuating pressure within compression bore 64 is decreased during the third situation. That is, compression of the refrigerant within orifice 136 can only occur when the pressure within compression bore 64 is greater than the pressure of the refrigerant within orifice 136. By providing the greatest possible amount of pressure to the liquid refrigerant within orifice 136, compression of the refrigerant does not occur until the last possible moment when the pressure within compression bore 64 becomes greater than the pressure of the refrigerant within orifice 136. That is, under the third situation, compression and re-expansion of the refrigerant within orifice 136 and the inlet path is minimized because the refrigerant pressure within orifice 136 is maximized via the structure of the inlet path. The point in time when the pressure within pressure chamber 65 becomes equal to the refrigerant pressure within orifice 136 occurs later in the compression cycle and, thus, any compression and re-expansion which does occur is substantially minimized. Work done by the compression and re-expansion of the refrigerant occurs over a short period of time and, therefore, the total work done is substantially decreased. Consequently, it can be seen that by providing an inlet path which continually decreases in cross-sectional area, compression and re-expansion of the refrigerant within orifice 136 and the inlet path is decreased and the efficiency of rotary compressor 10 is increased.

Further yet, the above described increase in efficiency is accomplished by eliminating the need for liquid refrigerant restriction 26, commonly known as a capillary tube, and, therefore, the overall cost of manufacturing the refrigeration system is also decreased.

While the invention has been described as having a specific embodiment, it will be understood that it is capable of further modification. This application is therefore intended to cover any variations, uses or adaptations of the invention following the general principles thereof and including such departures from the present disclosure as come within known or customary practice in the art to which this invention pertains and fall within the limits of the appended claims.

What is claimed is:

1. In a rotary compressor for a refrigeration system, an injection cooling arrangement comprising:

a compression bore defined by a compression cylinder, a top planar portion and a lower planar portion;

a roller operably disposed within said cylinder bore for eccentric rotation therein;

a vane slot within said compression cylinder;

a sliding vane slidingly received within said vane slot;

means for biasing said one vane against said roller thereby defining a high pressure chamber and a low pressure chamber;

an orifice in said lower planar portion leading to said high pressure chamber of said cylinder bore, said orifice being opened and closed by said roller as said roller rotates within said cylinder bore; and a liquid refrigerant inlet path connecting together a liquid refrigerant supply and said orifice, said path decreasing in cross-sectional area towards said orifice, said inlet path including a first bore communicating with a liquid refrigerant line connected to the high pressure side of said refrigeration system, said first bore being smaller in cross-sectional area than said liquid refrigerant line, a second bore communicating with said first bore and extending through said compression cylinder and into said lower planar portion, said second bore having a smaller cross-sectional area than said first bore, and a third bore communicating with said second bore and extending through and communicating with said orifice, said third bore having a smaller cross-sectional area than said second bore and a larger cross-sectional area than said orifice.

2. The injection cooling arrangement of claim 1 wherein said orifice is located such that it will be closed by said roller just prior to the time when the pressure within said high pressure chamber exceeds the refrigerant pressure within said orifice during normal loading conditions encountered by said refrigeration system.

3. The injection cooling arrangement of claim 1 further comprising a liquid refrigerant line connected at one end thereof to the high pressure side of said refrigeration system and to said inlet path at the other end thereof, said liquid refrigerant inlet path comprising a first bore communicating with said liquid refrigerant line within said compression cylinder, said first bore being smaller in cross-sectional area than said liquid refrigerant line, a second bore communicating with said first bore and extending through said compression cylinder and into said lower planar portion, said second bore having a smaller cross-sectional area than said first bore, and a third bore within said lower planar portion communicating with said second bore and extending to and communicating with said orifice, said third bore having a smaller cross-sectional area than said second bore and a larger cross-sectional area than said orifice.

4. The injection cooling arrangement of claim 3 wherein said orifice is located so that it will be closed by said roller just prior to the time when the pressure within said high pressure chamber exceeds the refrigerant pressure within said orifice during normal loading conditions to be encountered by said refrigeration system.

5. In a rotary compressor for a refrigeration system, an injection cooling arrangment comprising:

a compression bore defined by a compression cylinder for compressing refrigerant therein, said compression bore further defined by a top planar portion and a lower planar portion, said portions disposed perpendicularly to said bore;

a roller operably disposed in said bore;

an orifice disposed in said compression cylinder and leading into said compression bore for introducing liquid refrigerant into said bore, said orifice located such that it will be intermittently closed by said roller;

a liquid refrigerant inlet path within said compression cylinder for conducting liquid refrigerant to said orifice, said inlet path including a first bore communicating with a liquid refrigerant line connected to the high pressure side of said refrigeration system, said first bore being smaller in cross-sectional area than said liquid refrigerant line, a second bore communicating with said first bore and extending through said compression cylinder and into said lower planar portion, said second bore having a smaller cross-sectional area than said first bore, and a third bore communicating with said second bore and extending through and communicating with said orifice, said third bore having a smaller cross-sectional area than said second bore and a larger cross-sectional area than said orifice.

6. The injection cooling arrangement of claim 5, wherein said orifice is located such that it will be closed by said roller within said compression bore just prior to the time when the pressure within said bore exceeds the refrigerant pressure within said orifice during normal loading conditions encounted by said refrigeration system.

* * * * *